US008248195B2

(12) United States Patent
Ryuen et al.

(10) Patent No.: US 8,248,195 B2
(45) Date of Patent: Aug. 21, 2012

(54) FLAT ELECTROMAGNETIC ACTUATOR

(75) Inventors: Shigeto Ryuen, Sendai (JP); Kenji Suda, Sendai (JP)

(73) Assignee: Keihin Corporation, Tokyo (JP)

( * ) Notice: Subject to any disclaimer, the term of this patent is extended or adjusted under 35 U.S.C. 154(b) by 362 days.

(21) Appl. No.: 12/222,438

(22) Filed: Aug. 8, 2008

(65) Prior Publication Data

US 2009/0039992 A1 Feb. 12, 2009

(30) Foreign Application Priority Data

Aug. 10, 2007 (JP) ..... 2007-209768
Aug. 10, 2007 (JP) ..... 2007-209782

(51) Int. Cl.
*H01F 7/08* (2006.01)

(52) U.S. Cl. ..... 335/220; 335/236; 335/255; 335/261; 335/262; 335/270; 335/273; 335/278; 335/279; 335/281; 335/282; 335/296; 335/297; 335/299

(58) Field of Classification Search ..... 335/220, 335/236, 253, 255, 258, 261, 262, 270, 273, 335/274, 278, 279, 281, 282, 296, 297, 299; 310/12, 15, 17, 23, 24
See application file for complete search history.

(56) References Cited

U.S. PATENT DOCUMENTS

| | | | | |
|---|---|---|---|---|
| 1,344,260 | A * | 6/1920 | Canfield | 388/858 |
| 2,407,963 | A * | 9/1946 | Persons | 335/261 |
| 3,229,171 | A * | 1/1966 | Daugherty | 335/272 |
| 4,093,931 | A * | 6/1978 | Fenton | 335/272 |
| 5,883,557 | A * | 3/1999 | Pawlak et al. | 335/179 |
| 6,615,780 | B1 * | 9/2003 | Lin et al. | 123/90.17 |
| 7,209,020 | B2 * | 4/2007 | Telep | 335/255 |
| 7,808,134 | B2 * | 10/2010 | Burnett et al. | 310/14 |
| 2002/0104977 | A1 * | 8/2002 | Bircann et al. | 251/129.15 |
| 2004/0257185 | A1 * | 12/2004 | Telep | 335/220 |
| 2005/0024174 | A1 * | 2/2005 | Kolb et al. | 335/220 |
| 2005/0133099 | A1 * | 6/2005 | Ino et al. | 137/625.65 |
| 2009/0051471 | A1 * | 2/2009 | Zhao | 335/261 |

FOREIGN PATENT DOCUMENTS

JP 2005-317939 11/2005

* cited by examiner

*Primary Examiner* — Mohamad Musleh
(74) *Attorney, Agent, or Firm* — Squire Sanders (US) LLP

(57) ABSTRACT

A flat electromagnetic actuator includes a solenoid, a shaft at the center thereof, first and second bearings, a projecting supporting part, a movable core having an annular projection, a cylindrical yoke, a coil bobbin, a coil and a cylindrical housing whose top is closed, wherein an axial dimension thereof is shorter than a radial dimension thereof, and wherein the second bearing, the projecting supporting part, the movable core, the annular projection, the cylindrical yoke, the coil bobbin, and the housing are disposed on a same surface perpendicular to a displacement direction of the shaft, and continuously provided in the radial direction.

5 Claims, 6 Drawing Sheets

COMPARATIVE EXAMPLE

THIS INVENTION

COMPARATIVE EXAMPLE

THIS INVENTION

COMPARATIVE EXAMPLE

THIS INVENTION

COMPARATIVE EXAMPLE

THIS INVENTION

FLAT ELECTROMAGNETIC ACTUATOR

CROSS-REFERENCE TO RELATED APPLICATION(S)

This application claims the foreign priority benefit under Title 35, United States Code, §119(a)-(d), of Japanese Patent Application No. 2007-209768A and No.2007-209782A, filed on Aug. 10, 2007 in the Japan Patent Office, the disclosure of which is herein incorporated by reference in its entirety.

BACKGROUND OF THE INVENTION

Field of the Invention

The present invention relates to a thin, flat electromagnetic actuator whose axial dimension is shorter than a radial dimension thereof.

There have been used in the prior art electromagnetic valves for displacing a valve element by attracting a movable iron core to a fixed iron core under an electromagnetic force that is generated when a solenoid is energized.

JP2005-317939A discloses a linear solenoid valve, provided by the applicant of the present invention, which can improve an attracting force for a movable core and be reduced in size by positioning an outer circumferential face of an annular projection of the movable core and a bottom wall face of a housing in partially overlapping relation to each other.

The linear solenoid valve provided by the applicant and conventional electromagnetic actuators are formed in a cylindrical shape, wherein the axial dimensions of a housing and a coil winding unit are longer than the radial dimensions of these. Turns of the coil wound on the solenoid of the electromagnetic actuators can be increased by extending the axial dimension of the actuators rather than extending the radial dimension, which can increase the density of turns of the coil wound on the solenoid and improve a magnetic attracting force.

There is a demand for a thin flat electromagnetic actuator operated in the axial direction, wherein the axial dimensions of the housing and the coil winding unit are shorter than the radial directions, thereby being capable of installing where a space for installation is limited in a height direction (displacement direction of a movable body of the electromagnetic actuator) and providing a desired layout.

BRIEF SUMMARY OF THE INVENTION

An aspect of the present invention provides a thin, flat electromagnetic actuator having a magnetic attracting force equal to that of a conventional electromagnetic actuator, wherein an axial dimension of a housing is shorter than a radial dimension thereof.

The flat electromagnetic actuator of the present invention includes a movable body (movable core) disposed at the center thereof, bearings, a projecting supporting part, an annular projection, a cylindrical yoke, and a coil stacked body, which are successively disposed on a same plane in the outer radial direction thereof and continuously provided in the radial direction thereof. Preferably, the same plane is a cross section which is perpendicular to the displacement direction of the movable body. Accordingly, the flat electromagnetic actuator of the present invention can prevent the elements thereof from being disposed in the axial direction and make the axial dimension thereof short, because the elements are successively disposed on the same face in the outer radial direction thereof. Consequently, the flat electromagnetic actuator can be installed where a space for installation is limited in a height direction due to an obstacle, and provide a desired layout.

The flat electromagnetic actuator of the present invention includes the annular projection having an annular inclined face and a longitudinal tapered cross section, which can collect a large amount of magnetic fluxes and provide a large magnetic attracting force equal to that of a conventional electromagnetic actuator, notwithstanding the coil stacked body formed in a flat shape in the axial direction.

The flat electromagnetic actuator of the present invention includes an attracting tapered part downwardly protruding and continuously forming on the ceiling face thereof, which makes unnecessary a conventional cylindrical part extending in the axial direction and circumferentially disposed on the ceiling face (FIG. 5A), and accordingly makes the axial dimension thereof short (FIG. 5B).

The flat electromagnetic actuator of the present invention includes a recessed inner wall formed on the inner circumferential side of the attracting tapered part and disposed above the ceiling face formed on the outer circumferential side of the attracting tapered part (FIG. 4). Accordingly, the flat electromagnetic actuator can extend an operational stroke (variation) of the movable core by a dimensional difference in the vertical direction between the recessed inner wall and the ceiling face, which provides a large operational stroke in the axial direction, notwithstanding the flat shape thereof.

The flat electromagnetic actuator of the present invention can easily be manufactured because of a simple structure of the attracting tapered part having an approximately vertical cross section on the inner circumferential side thereof, and an inclined cross section on the outer circumferential side thereof.

DETAILED DESCRIPTION OF THE PREFERRED EMBODIMENTS

Figure 1:
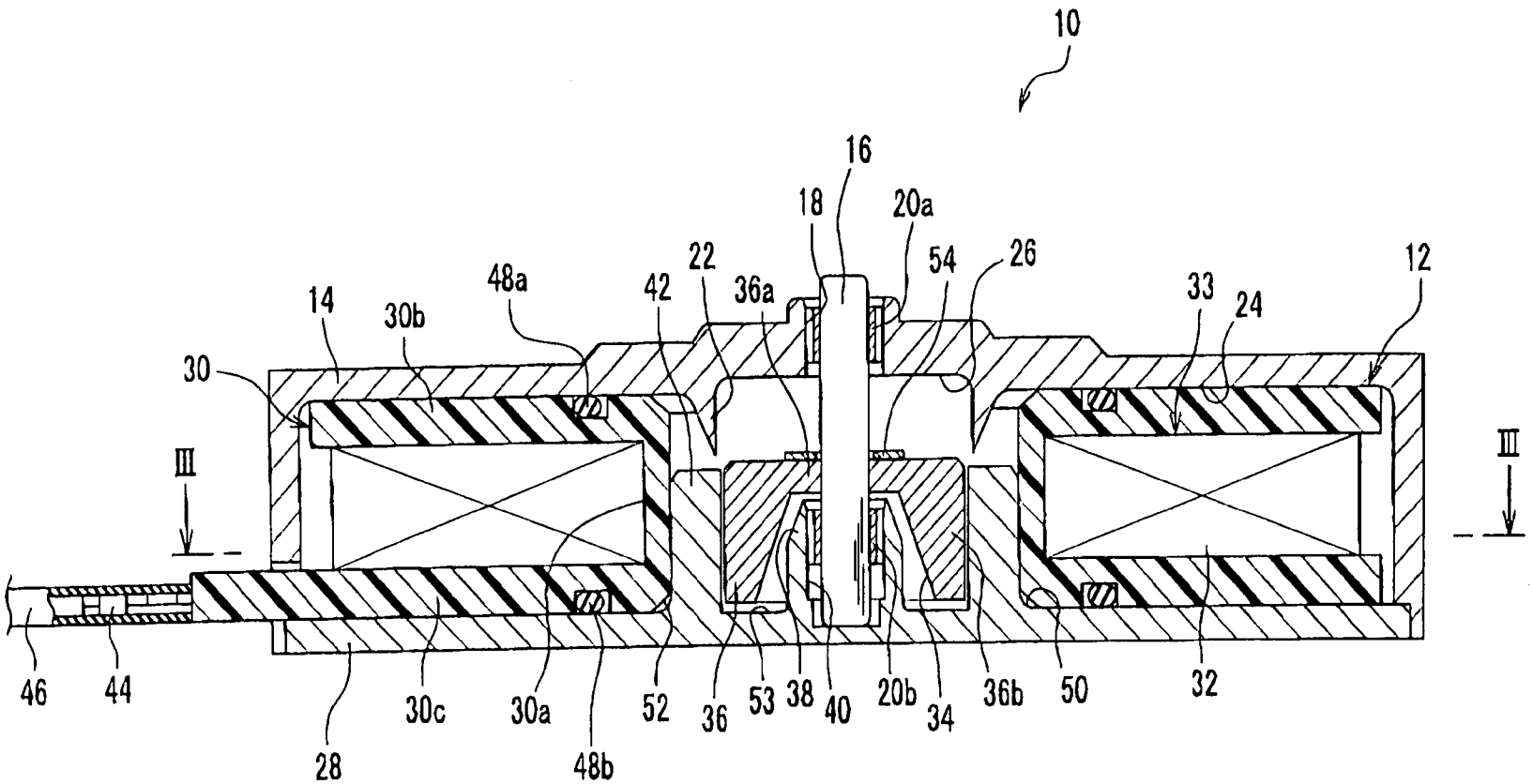
FIG. 1 is a longitudinal sectional view of a flat electromagnetic actuator according to the present invention.

FIG. 1 shows a flat electromagnetic actuator 10 according to an embodiment of the present invention. The flat electromagnetic actuator 10 includes a solenoid 12 and a cylindrical, flat housing 14 whose radial dimension is longer than the axial dimension and whose upper end is closed. The housing 14 is a main body of the flat electromagnetic actuator, and preferably made of a magnetic material such as SUM (Japanese Industrial Standard).

The housing 14 includes a hole 18 formed at the center thereof through which a shaft 16 (movable body) described later penetrates. A first flat bearing 20*a* is inserted into the hole 18, and slidably supports an outer circumferential face of an upper part of the shaft 16. For example, a one-layer halved bearing made of an alloy is used for the first flat bearing 20*a*. A plurality of communicating channels extending in the axial direction are formed on the outer circumferential face of the first flat bearing 20*a*. Two-layer or multi-layer bearing not shown may as well be used for the first flat bearing 20*a*.

An annular attracting tapered part 22 downwardly protruding a predetermined distance forms on an inner wall of the upper end of the housing 14. The attracting tapered part 22 includes an approximately vertical face 22*a* on an inner circumferential side thereof, and an annular inclined surface 22*b* whose diameter is gradually contracted downwardly on an outer circumferential side thereof (FIG. 4).

Figure 4:
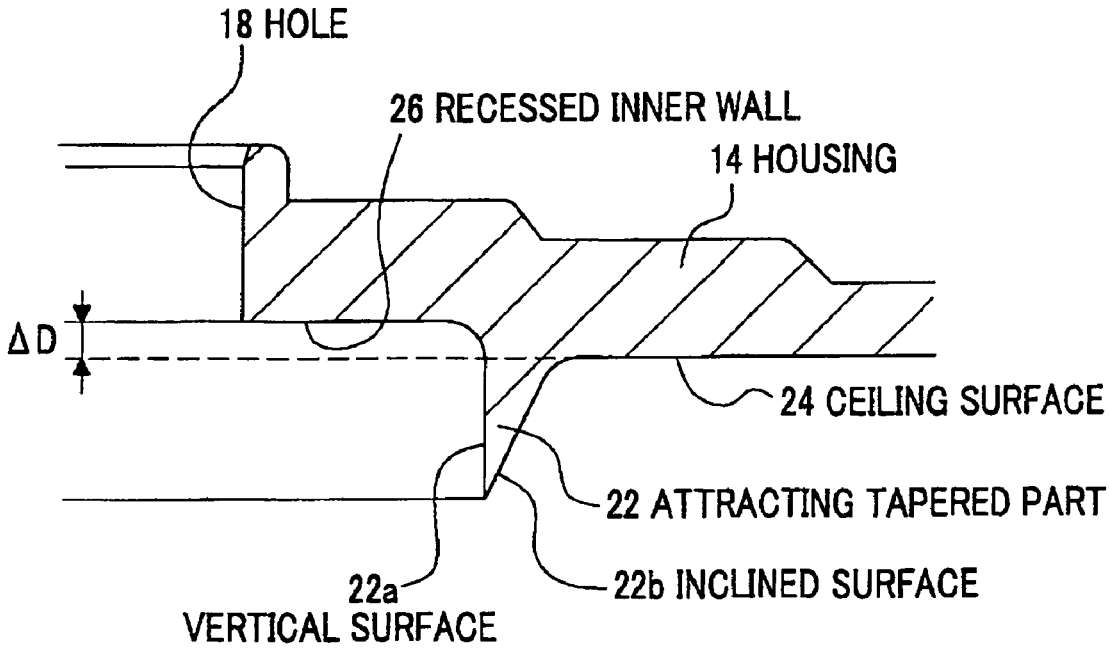
FIG. 4 is an enlarged fragmentary longitudinal sectional view of the flat electromagnetic actuator.

A dimensional difference ΔD between a ceiling face 24 and a recessed inner wall 26 is generated in the vertical direction, the ceiling face 24 continuously formed in the horizontal direction on the outer circumferential side of the attracting tapered part 22 disposed on the inner wall of the housing 14, and the recessed inner wall 26 continuously formed in the horizontal direction on the inner circumferential side of the attracting tapered part 22 (FIG. 4). Accordingly, the recessed inner wall 26 formed on the inner circumferential side is positioned above the ceiling face 24 formed on the outer circumferential side by the difference ΔD in the vertical direction.

As shown in FIG. 1, the solenoid 12 includes an approximately disc-shaped fixed core 28 which is press-fitted into a lower end of the housing 14 which is hollow in the bottom, a coil bobbin 30 having a hole penetrated and disposed at the center of the housing 14 and having a longitudinal U-shaped cross section in the radial direction, a flat coil stacked body 33 (FIG. 7B) wherein the coil 32 wound on the coil bobbin 30 is stacked, a movable core 36 whose diameter is gradually increased downwardly, the movable core 36 including an annular inclined face 34 having a diameter progressively larger toward the fixed core 28 on the inner side thereof and a longitudinal tapered cross section, and a short shaft 16 (movable body) fixed in the hole formed at the center of the movable core 36 and integrally movable with the movable core 36.

When the fixed core 28 is press-fitted in the housing 14, a glue may as well be used in the connected part between the fixed core 28 and the housing 14. Preferably, the movable core 36 and the shaft 16 can integrally be connected by press-fitting. Preferably, the shaft 16 can be made of a non-magnetic material such as SUS 303 (Japanese Industrial Standard).

An annular projecting supporting part 38 formed in the neighborhood of the center of the fixed core 28 upwardly protrudes a predetermined distance. The projecting supporting part 38 includes a dent 40 whose longitudinal cross section is formed in a U-shape. A second flat bearing 20*b* which slidably supports the outer circumferential face of a lower end of the shaft 16 is inserted into the dent 40. The second flat bearing 20*b* is a part of bearing member, which includes the first flat bearing 20*a*.

A cylindrical yoke 42 disposed in the radial outer direction of the projecting supporting part 38 is expansively formed in an upward vertical direction. The cylindrical yoke 42 is formed greater in thickness and height than the projecting supporting part 38. Preferably, a magnetic material such as SUYB (Japanese Industrial Standard) can be used for the projecting supporting part 38 and the fixed core 28 including the cylindrical yoke 42.

The coil bobbin 30 is formed of a resin material, and includes a cylindrical part 30*a* having a hole being penetrated at the center of the housing 14, in which the cylindrical yoke 42 is inserted, and annular flanges 30*b* and 30*c* which horizontally protrude a predetermined distance from both the upper and lower ends of the cylindrical part 30*a* in the radial outward direction respectively. The coil bobbin 30 integrally forms the cylindrical part 30*a* and the annular flanges 30*b* and 30*c*. The outer diameter of the annular flanges 30*b* and 30*c* formed in a flat round shape is greater than the axial dimension of the cylindrical part 30*a*.

Preferably, a square conducive wire having a square cross section or a flat conductive wire having a rectangular cross section can be used for the coil 32 wound on the coil bobbin 30. The turns of the coil 32 wound on the coil bobbin 30 are held in surface-to-surface contact with each other. Accordingly, the coil 32 can stably be disposed in a predetermined position in proper alignment. A terminal end of the coil 32 is electrically connected to a lead line 46 via a terminal 44 provided outside the housing 14. A coupler not shown may as well be used to electrically connect the lead line 46 to the coil 32 instead of the terminal 44. O-rings 48*a* and 48*b* are respectively disposed on an upper face of the annular flange 30*c* and a lower face of the annular flange 30*b* of the coil bobbin 30 in annular channels. O-rings 48*a* and 48*b* can seal spaces, both between the ceiling face of the housing 14 and the coil bobbin 30*b* and between a flat face of the fixed core 28 and the coil bobbin 30*c* respectively. A curved face 50 disposed on the outer circumferential side of the cylindrical yoke 42 connects the fixed core 28 with the cylindrical yoke 42. The curved face 50 includes a longitudinal cross section formed in an arc-shaped R. A tapered space 52 is formed between the bottom of the cylindrical part 30*a* and the curved face 50 so as to relieve a slight difference in size between the fixed core and the coil bobbin.

The movable core 36 includes a flat plate 36*a* on the top thereof and an annular projection 36*b* having an annular inclined face 34 and a longitudinal cross section formed approximately in a trapezoid. The annular inclined face 34 is disposed opposite to the annular projecting supporting part 38 of the fixed core 28 via a predetermined gap therebetween. The flat plate 36*a* and the annular projection 36*b* are integrally formed. Preferably, a magnetic material such as SUYB (Japanese Industrial Standard) can be used for the movable core 36.

The annular projection 36*b* whose longitudinal cross section is formed in a tapered shape includes the annular inclined face 34 having a diameter progressively larger downwardly on the inner side thereof, and extends a predetermined distance toward the fixed core 28. The annular projection 36*b* of the movable core 36 is fitted into an annular space 53 formed between the annular projecting supporting part 38 and the cylindrical yoke 42, which can increase a magnetic attracting force under a magnetizing action.

A ring 54, which is a flat washer, is mounted on the outer circumferential face of the shaft 16, and disposed close to a top of the flat plate 36*a* of the movable core 36. The ring is formed of a non-magnetic material such as SUS 310 (Japanese Industrial Standard) and function as a spacer for preventing residual magnetism from being produced in the solenoid 12 brought out of conduction.

The upper end of the shaft 16 is exposed to the outside from the hole 18 of the housing 14. The upper and lower parts of the shaft 16 are slidably supported by the first and second flat bearings 20*a* and 20*b* respectively in the axial direction, which allows the flat electromagnetic actuator 10 to minimize a magnetic gap and produce a desired magnetic attracting force.

The flat electromagnetic actuator 10 of the embodiment is provided as described above. The operation and effect of the flat electromagnetic actuator 10 will be described hereinafter.

As shown in FIG. 1, when the coil 32 wound on the solenoid 12 is not conducted, the movable core 36 is disposed in an inner space of the cylindrical yoke 42, which is an initial position for the movable core 36 shown in FIG. 1. The flat electromagnetic actuator 10 include an upper face which is on the top of the housing 14 wherein an end of the shaft 16 is exposed to the outside from the hole 18 at the center, and an lower face which is a bottom of the fixed core 28. The flat electromagnetic actuator 10 is disposed on a member not shown. The operation of the flat electromagnetic actuator 10 will be described hereinafter, regarding a displacement direction of the shaft 16 (axial direction of shaft 16) as a height direction, and a horizontal direction perpendicular to the axis of the shaft as a radial direction.

Figure 2:
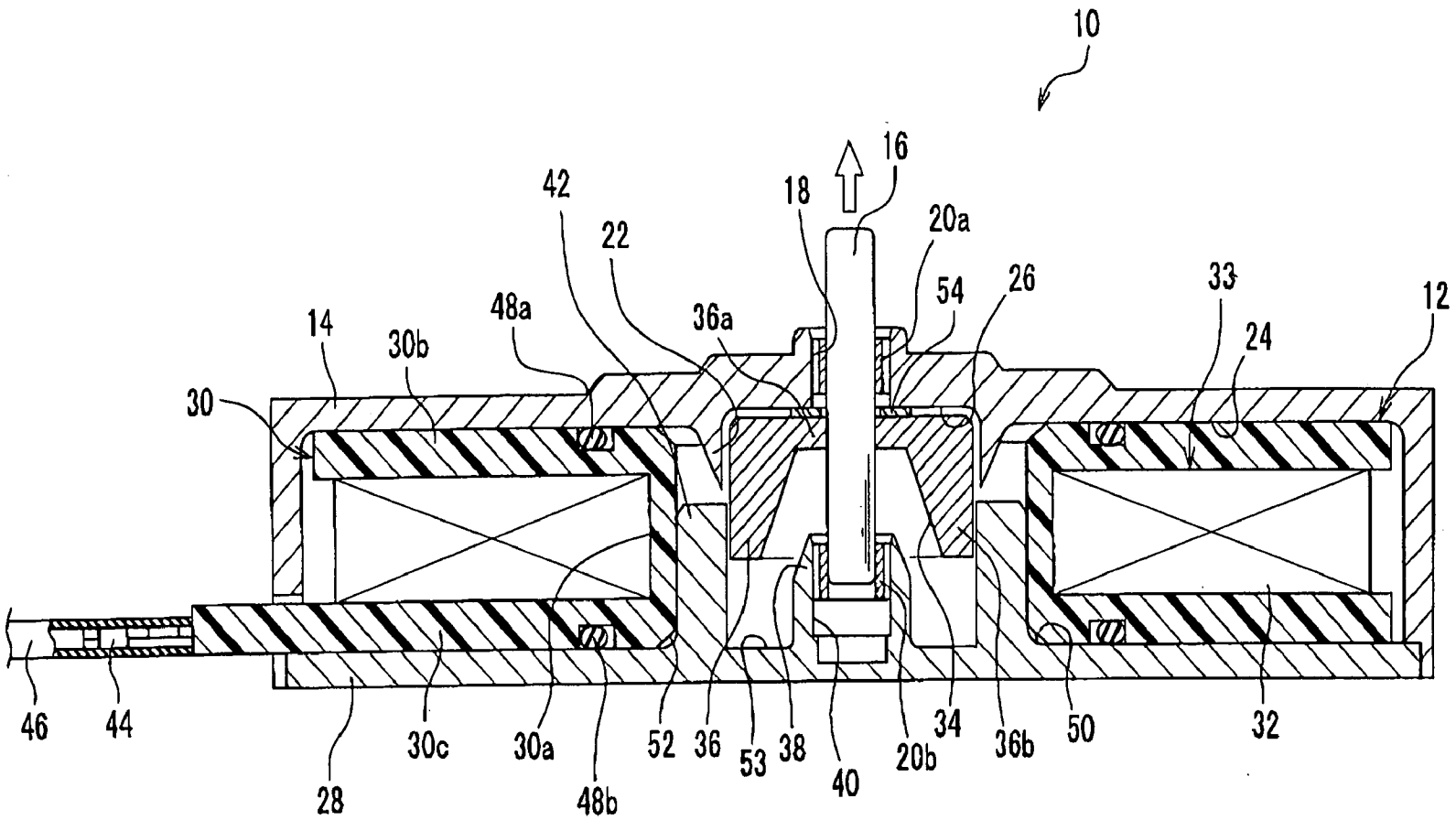
FIG. 2 is a longitudinal sectional view of the flat electromagnetic actuator wherein a movable core is upwardly disposed.

When a power supply not shown is turned on, the coil 32 wound on the solenoid 12 is energized, which turns on the flat electromagnetic actuator 10 and generates a magnetic circuit (magnetic flux) not shown. The magnetic circuit is formed of magnetic fluxes which run from the housing 14 and successively transfer via the attracting tapered part 22, the movable core 36, and the fixed core 28, and return to the housing 14. An electromagnetic force generated by the magnetic circuit attracts the movable core 36 to the attracting tapered part 22 disposed on the inner wall of the upper part of the housing 14. The shaft 16 integrally connected with the movable core 36 is upwardly transferred and guided by the first and second flat bearings 20*a* and 20*b*. The movable core 36 is fitted into the recessed inner wall 26 on the inner circumferential side of the attracting tapered part 22 (FIG. 2). The ring 54 fastened with the outer circumferential face of the shaft 16 comes into contact with the recessed inner wall 26 on the inner circumferential side of the attracting tapered 22. Accordingly, a variation of movable core in the height direction is limited.

When the power supply is turned off, the coil 32 wound on the solenoid 12 is de-energized, and the electromagnetic force disappears. A pressing force generated by a return mechanism (for example, a return spring fastened with a spool valve not shown), disposed on a member not shown which connects with the tip end of the shaft 16, downwardly acts on the movable core 36 and the shaft 16 which return to the first position.

Figure 3:
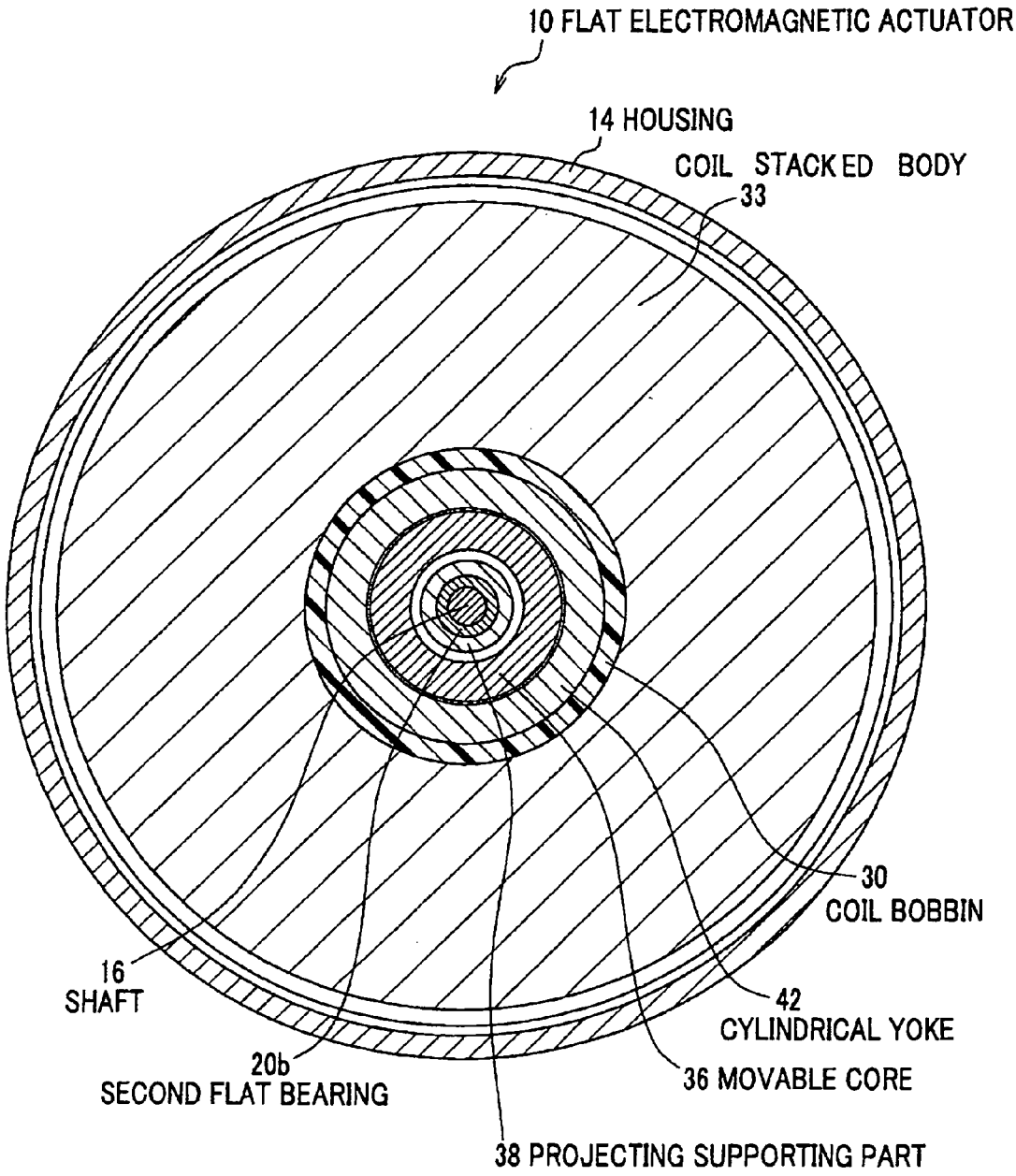
FIG. 3 is a transverse sectional view of the flat electromagnetic actuator in a horizontal direction.

As shown in FIG. 3, the second flat bearing 20*b*, the projecting supporting part 38, the annular projection 36*b* of the movable core 36, the cylindrical yoke 42, the coil bobbin 30, the coil 32 (coil stacked body 33), and the housing 14 are successively disposed on the same face. These elements are continuously provided in the radial direction.

Accordingly, the electromagnetic actuator 10 of the embodiment can provide a thin, flat structure wherein the elements are successively disposed on the same face in the radial direction, which makes the axial dimension thereof short. Consequently, the flat electromagnetic actuator 10 of the embodiment can be installed where a space for installation is limited in the height direction due to an obstacle, and provide a desired layout.

The flat electromagnetic actuator 10 of the embodiment can provide a desired driving source instead of a flat motor. The flat electromagnetic actuator 10 does not include a rotary-linear converting mechanism for converting rotary motion into linear motion, which allows the flat electromagnetic actuator 10 to achieve a cost reduction by reducing the number of parts, prevents an operational delay in converting a rotational movement into a linear movement, and improves a responsiveness in operation.

The flat electromagnetic actuator 10 of the embodiment includes the annular projection 36*b* protruding a predetermined distance toward the fixed core 28. The annular projection 36*b* whose longitudinal cross section is formed in a tapered shape includes an annular inclined face 34 having a diameter progressively larger downwardly on the inner side thereof, and is fitted into the annular space 53 formed between the projecting supporting part 38 and the cylindrical yoke 42, which increases a magnetic attracting force generated from the coil to be energized. Accordingly, the flat electromagnetic actuator 10 can obtain a magnetic attracting force equal to that of a conventional electromagnetic actuator.

Figure 5A:
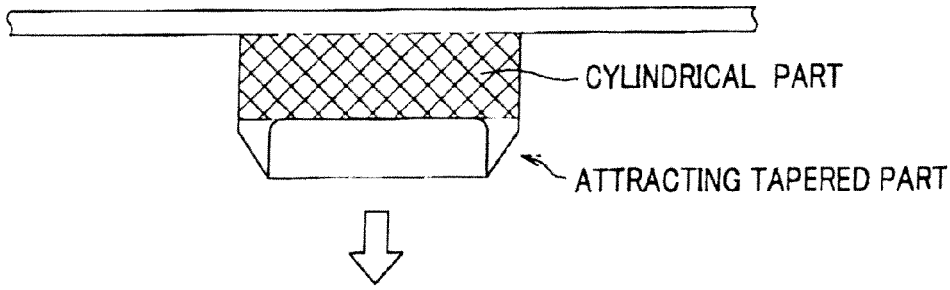
PRIOR ART FIG.5A
FIG. 5A is a longitudinal sectional view of an attracting tapered part according to a comparative example.
Figure 5B:
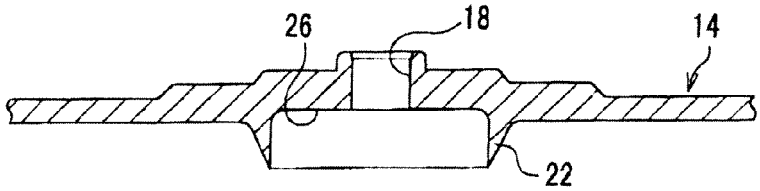
FIG. 5B is a longitudinal sectional view of an attracting tapered part according to the embodiment of the present invention.

In the embodiment, the flat electromagnetic actuator 10 includes the attracting tapered part 22 downwardly protruding and continuously forming on the ceiling face 24 of the housing 14, which makes unnecessary a conventional cylindrical part continuously downwardly extending in the axial direction in the housing as shown with comparative example of FIG. 5A. Accordingly, the flat attracting tapered part 22 can help to make the flat electromagnetic actuator 10 shorter in the height direction (FIG. 5B).

Figure 6A:
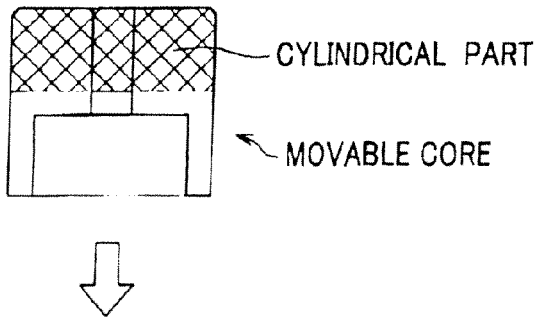
FIG.6A PRIOR ART
FIG. 6A is a longitudinal sectional view of a movable core according to the comparative example.
Figure 6B:
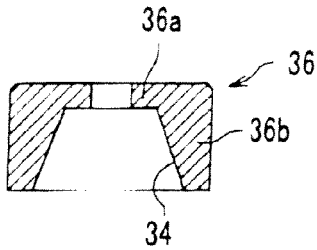
FIG. 6B is a longitudinal sectional view of a movable core according to the embodiment of the present invention.

In the embodiment, the movable core 36 includes the thin flat plate 36*a* and the annular projection 36*b* having a longitudinal tapered cross section and the annular inclined face 34 on the inner side thereof, which makes unnecessary a conventional cylindrical part extending in the axial direction as shown with a comparative example of FIG. 6A. Accordingly, the flat movable core 36 can help to make the flat electromagnetic actuator 10 shorter in the height direction (FIG. 6B).

Figure 7A:
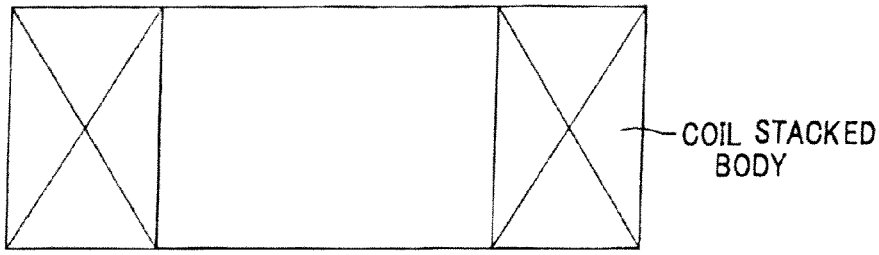
FIG.7A PRIOR ART
FIG. 7A is a longitudinal sectional view of a coil stacked body according to the comparative example.
Figure 7B:
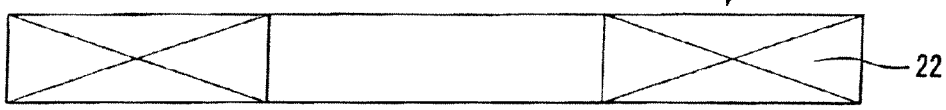
FIG. 7B is a longitudinal sectional view of a coil stacked body according to the embodiment of the present invention.
Figure 8A:
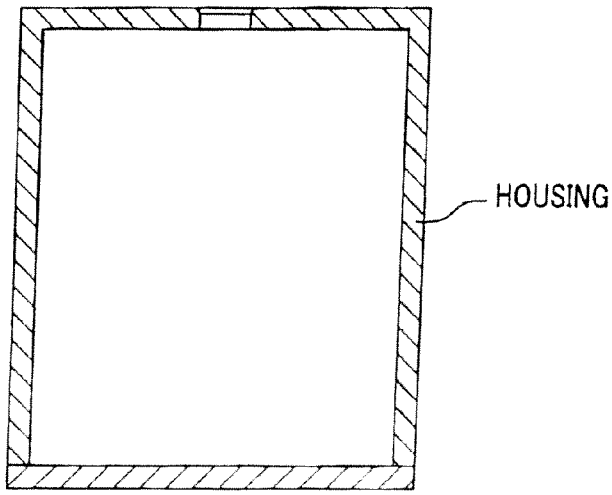
FIG.8A PRIOR ART
FIG. 8A is a longitudinal sectional view of a housing according to the comparative example.
Figure 8B:
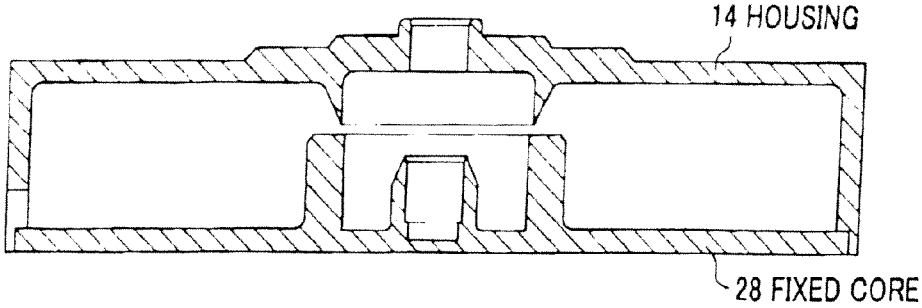
FIG. 8B is a longitudinal sectional view of a housing according to the embodiment of the present invention.

In the embodiment, the flat electromagnetic actuator 10 includes the flat coil stacked body 33 (FIG. 7B) and the flat housing 14 (FIG. 8B), compared with a conventional coil stacked body and a housing as shown with comparative examples of FIG. 7B and FIG. 8B. The annular projection of the movable core 36 having the longitudinal tapered cross section and the annular inclined face on the inner side thereof can achieve a high magnetic flux density and allows the flat electromagnetic actuator 10 to obtain a large magnetic attracting force.

As shown in FIG. 4, the flat electromagnetic actuator 10 of the embodiment includes the ceiling face 24 continuously disposed in the horizontal direction on the outer circumferential side of the attracting tapered part 22 formed on the inner wall of the housing 14, and the recessed inner wall 26 continuously disposed in the horizontal direction on the inner circumferential side of the attracting tapered part 22, therebetween the dimensional difference $\Delta D$ in the vertical direction is generated. Accordingly, the flat electromagnetic actuator 10 can extend an operational stroke (variation) of the movable core 36 by the difference $\Delta D$. Consequently, the embodiment of the present invention can provide the flat electromagnetic actuator 10 wherein the variation of the movable core operated in the axial direction is large notwithstanding the thin, flat shape.

Accordingly, the embodiment provides the flat electromagnetic actuator 10 having a large magnetic attracting force equal to that of a conventional electromagnetic force, and a better hysteresis property, wherein the movable core 36 provides a large variation and a better linear movement with respect to the fixed core 28.

The embodiment is not limited to an electromagnetic actuator provided as an electromagnetic device. A valve mechanism not shown may as well be used. A valve element not shown disposed in the valve mechanism (for example, a spool valve and a poppet valve) may as well be driven on the basis of variation of the shaft 16.

What is claimed is:

1. A flat electromagnetic actuator, comprising:

a body which is composed of a single-piece member made of a magnetic material and comprises an attracting tapered part and a cylindrical, flat housing whose upper end is closed;

a flat coil stacked body configured to stack a coil wound on a coil bobbin and being disposed in the body;

a flat movable core configured to be attracted toward the attracting tapered part when the coil is energized, the movable core comprising a completely thin flat plate located on a top part of the flat movable core and facing the attracting tapered part, an annular projection and an annular inclined surface on an inner circumferential side thereof, the annular inclined surface having a tapered shape an approximately disc-shaped fixed core which is composed of a single-piece member made of a magnetic material and is located at a lower end of the housing which is hollow in the bottom, wherein the annular inclined surface has a diameter that becomes progressively larger toward the fixed core;

a movable body configured to integrally connect and transfer with the movable core;

bearings configured to support the movable body displaced in an axial direction thereof;

a projecting supporting part configured to face the annular inclined surface of the movable core and support one of the bearings; and a cylindrical yoke configured to enclose the annular projection of the movable core, wherein the movable core, one of the bearings, the projecting supporting part, the annular projection, the cylindrical yoke, and the coil stacked body are disposed on a same surface and successively annularly provided from a center thereof to an outer circumference thereof.

2. The flat electromagnetic actuator according to claim 1, wherein the same surface is comprised of a cross section perpendicular to a displacement direction of the movable body.

3. The flat electromagnetic actuator according to claim 1, wherein the attracting tapered part is annularly disposed on a ceiling surface of the body, and downwardly protrudes a predetermined distance.

4. The flat electromagnetic actuator according to claim 3, further comprising a recessed inner wall formed on an inner circumferential side of the attracting tapered part and positioned above the ceiling surface formed on an outer circumferential side of the attracting tapered part.

5. The flat electromagnetic actuator according to claim 3, wherein the attracting tapered part includes a vertical cross section on an inner circumferential side thereof and an inclined cross section on an outer circumferential side thereof.

* * * * *